United States Patent [19]

Cohen et al.

[11] Patent Number: 4,820,127

[45] Date of Patent: Apr. 11, 1989

[54] BLADE SUPPORT AND BLADE ASSEMBLY

[75] Inventors: Albert Cohen, Winter Springs; James T. Lipscomb, Oviedo; Richard J. Antos; Anthony E. Wesson, both of Winter Springs, all of Fla.

[73] Assignee: Westinghouse Electric Corp., Pittsburgh, Pa.

[21] Appl. No.: 149,315

[22] Filed: Jan. 29, 1988

[51] Int. Cl.[4] ..... F04B 1/06

[52] U.S. Cl. ..... 416/221; 416/206; 416/220 R

[58] Field of Search ..... 416/204 R, 204 A, 206, 416/219 R, 220 R, 221

[56] References Cited

U.S. PATENT DOCUMENTS

| | | | |
|---|---|---|---|
| 2,846,183 | 8/1958 | Morgan | 416/221 |
| 3,165,294 | 1/1965 | Anderson | 416/220 |
| 3,567,337 | 3/1971 | Zerlauth et al. | 416/221 |
| 3,711,220 | 1/1973 | Ramback et al. | 416/204 R |
| 3,799,699 | 3/1974 | Master et al. | 416/206 |
| 3,986,779 | 10/1976 | Beckershoff | 416/221 |

FOREIGN PATENT DOCUMENTS

| | | | |
|---|---|---|---|
| 976790 | 3/1951 | France | 416/221 |
| 986022 | 7/1951 | France | 416/221 |

*Primary Examiner*—Robert E. Garrett
*Assistant Examiner*—John T. Kwon

[57] ABSTRACT

A blade support and blade assembly has a cylindrical blade support with a slot in the outer periphery, the root of a blade disposed in the slot. The blade root has a groove in the bottom surface into which a locking pin, biased by a spring, is biased into the groove to lock the blade to the blade support. A bore is formed completely through the blade base extending from the outer surface thereof to the location of the locking pin, and a pin displacement, which may be a rod or a supply of pressurized fluid is operative to displace the pin from the groove in the blade base to permit removal of the blade root from the slot in the blade support. Hardened inserts may also be provided, either in the blade root or the blade support slot to strengthen the area of contact of the locking pin with the blade support and/or the blade root.

9 Claims, 4 Drawing Sheets

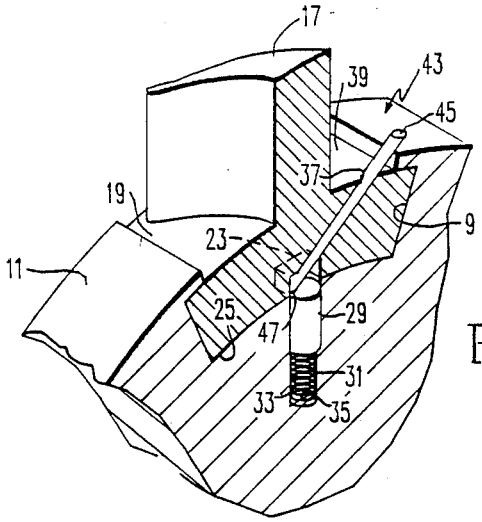
FIG. 3
FIG. 4
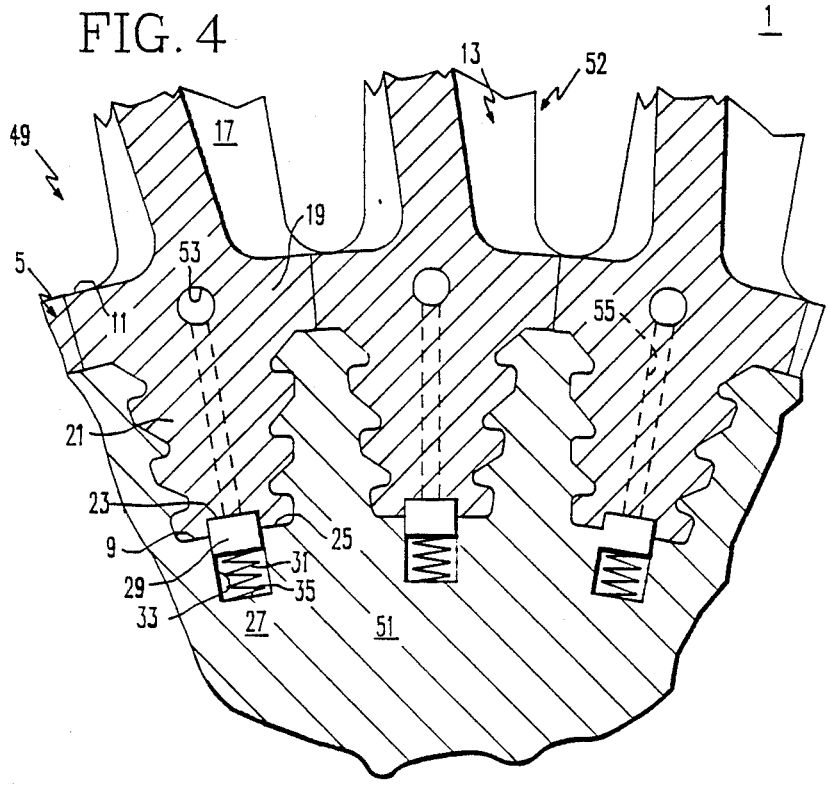

FIG. 5
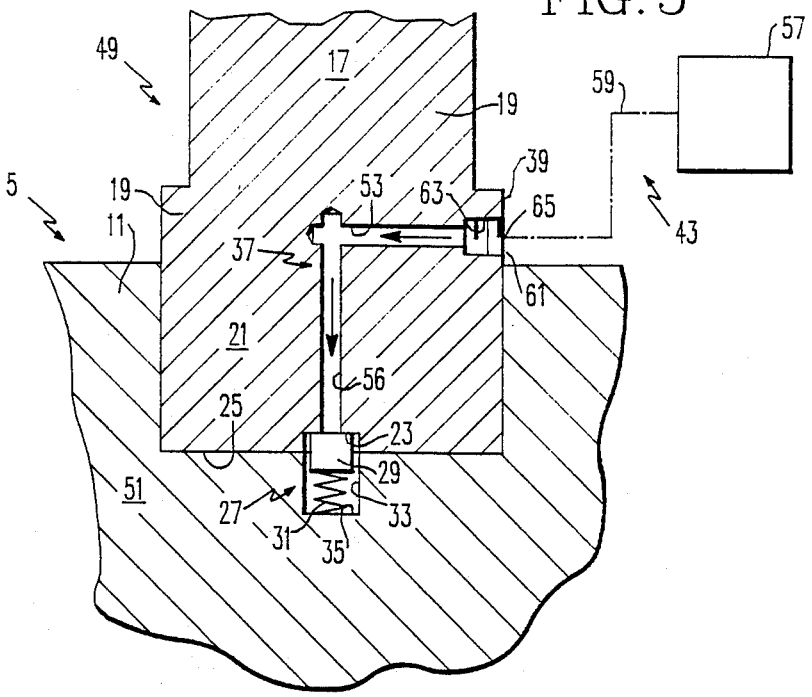
FIG. 7
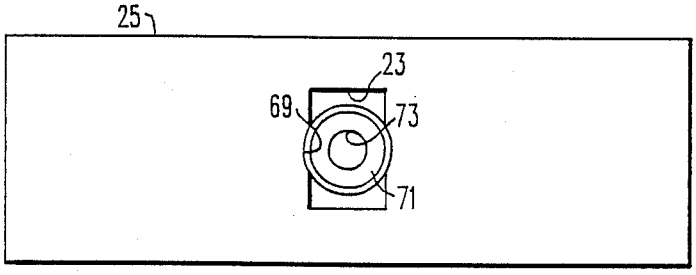
FIG. 8
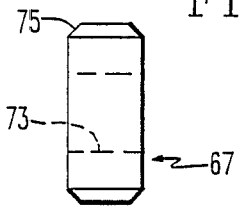
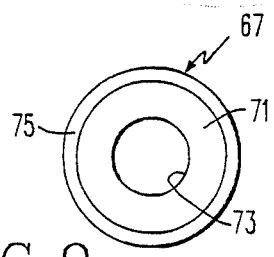
FIG. 9

FIG. 6
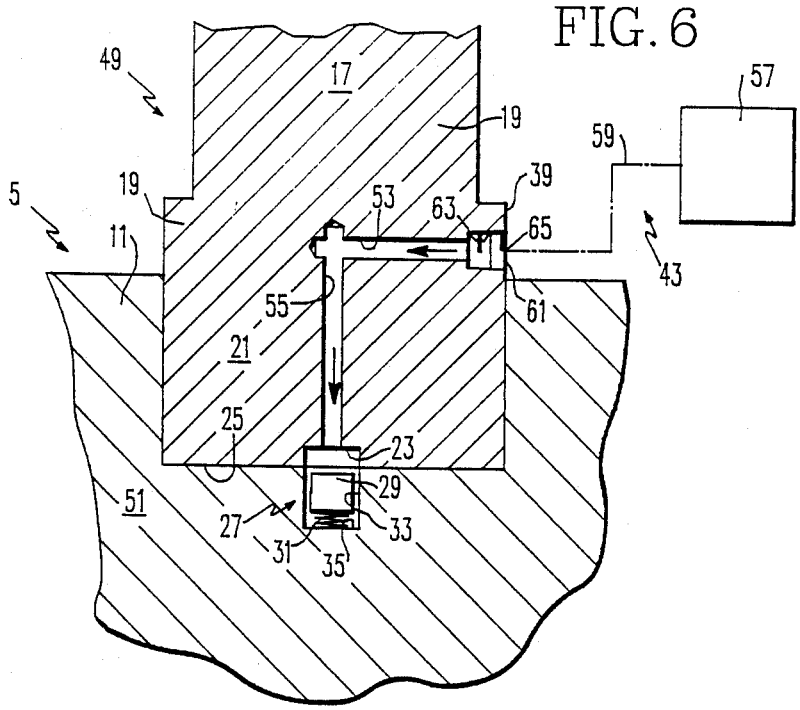
FIG. 10
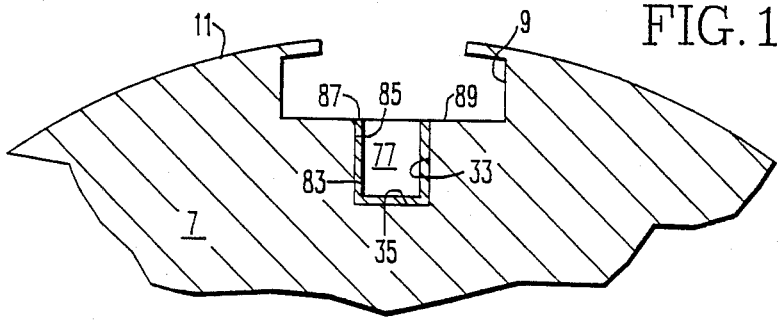
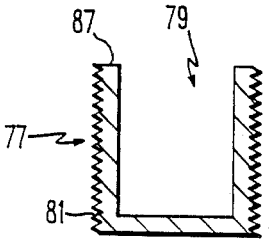
FIG. 11
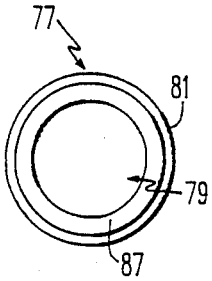
FIG. 12

BLADE SUPPORT AND BLADE ASSEMBLY

The use of blade supports and blade assemblies in fluid turbines is well known. Compressor blades, for example, are locked into position on a blade disk by the use of a spring loaded locking pin. Turbine blades may also be locked into position on a rotor by the use of a spring loaded locking pin.

A typical blade support and blade assembly includes a rotor or rotor disk that has a series of slots in the outer periphery thereof, with a blade having an airfoil section, base, and root section received in each of the slots by means of a sliding fit of the root section of the blade within a slot in the rotor or disk periphery. The blade must be locked into position on the rotor or disk and such locking can be effected by use of a spring biased locking pin which engages with both the root of the blade and the rotor or disk. The locking pin is positioned in an aperture in the bottom surface of the slot and a spring between the bottom of the locking pin and the rotor or disk biases the pin into engagement within a groove formed in the root of the blade.

In order to remove a blade from a blade rotor or disk and blade assembly, it is conventional to apply force to the base of the blade, such as by hammering on the blade, in the direction of the slot in the rotor or disk to shear the locking pin. Such hammering, of course, shears the pin and renders it unusable, as well as causing possible damage to the blade itself.

More recent designs of rotor or blade disk and blade assemblies call for the use of stronger locking pins to resist shearing of the pin during operation of the assembly. A problem exists, however, in that such stronger locking pins also resist shearing when a blade is to be removed from the rotor or blade disk and blade assembly. Forces sufficient to shear such stronger locking pins for removal of a blade can cause damage to or destroy the blade.

It is an object of the invention to provide a blade support and blade assembly that uses locking pins that enable the use of higher strength locking pins than presently used and will enable separation of a blade from a blade support without destruction of the locking pin or damage to the blade.

SUMMARY OF THE INVENTION

With this object in view, the present invention resides in a blade support and blade assembly having a cylindrical blade support with a slot in the outer periphery thereof, the blade having an airfoil section, a base, and a root section disposed in the slot, the root section having a groove therein, a locking pin positioned in the blade support extending into the groove of the root section of the blade to secure the root section to the support, and a biasing means situate in the blade support biasing the pin into the groove, with the blade having a bore formed therein extending completely through the blade base from the outer surface thereof to the location of the locking pin, such that a pin displacement means is operative from the outer surface of the base through the bore to oppose the biasing force of the biasing means and displace the pin from the groove, to permit removal of the blade root and blade from the slot.

The blade support and blade assembly may comprise a compressor blade disk and compressor blade assembly, or the same may comprise a turbine rotor and turbine blade assembly.

The pin displacement means may comprise a solid rod insertable through the bore in the base of the blade, from the end of the bore at the surface of the base to the pin. Or, the pin displacement means may comprise a source of fluid pressure and a pressure line, which line is engageable with the bore at the outer surface of the base, such that fluid under pressure may be charged from the pressure source, through the pressure line, and through the bore to contact the pin and displace the same. When a pressure source and pressure line are used, the bore, adjacent the outer surface of the blade base, has a threaded portion and the pressure line is adapted to be threadedly engaged with the threaded portion.

In a further embodiment of the present blade support and blade assembly, hardened inserts are provided either in the blade root or in the blade support slot, or both, which strengthen the area of contact of the locking pin with the blade support and/or blade root.

The present blade support and blade assembly allows for release of the locking pin which enables the use of stronger locking pins that could not be removed by the conventional method of hammering the blade out of securement with the blade support, and enables the reuse of locking pins, which pins are not sheared as in conventional blade support and blade assemblies, By using the present blade support and blade assemblies, neither the locking pin nor the blade are damaged upon removal of a blade root from the slot in the blade support periphery.

DESCRIPTION OF THE DRAWINGS

The invention will become more readily apparent from the following description of preferred embodiments thereof shown, by way of example only, in the accompanying drawings, wherein:

FIG. 3 is a view similar to FIG. 2 showing the locking pin depressed by a rod-shaped pin displacement means, unlocking the pin to enable removal of the blade from the slot in a blade disk;

FIG. 4 is a partial sectional view of a blade support and assembly, for a turbine, formed in accordance with the present invention;

FIG. 5 is a sectional view of a blade root and rotor of a turbine illustrated in FIG. 4 showing a locking pin in position locking a blade to a rotor;

FIG. 6 is a view similar to FIG. 5 showing the locking pin depressed by a source of pressurized fluid, as a pin displacement means, unlocking the pin to enable removal of the blade from the slot in the rotor;

FIG. 7 is a bottom plan view of another embodiment of the present invention showing a hardened insert positioned in the base of blade root;

FIG. 8 is a side elevational view of the insert of FIG. 7;

FIG. 9 is a top plan view of the insert of FIG. 7;

FIG. 10 is a sectional view of a further embodiment of the present invention showing a hardened insert positioned in the blade support at the bottom of the slot therein;

FIG. 11 is a sectional view of the insert of FIG. 10; and

FIG. 12 is a top plan view of the insert of FIG. 10.

DETAILED DESCRIPTION

Figure 1:
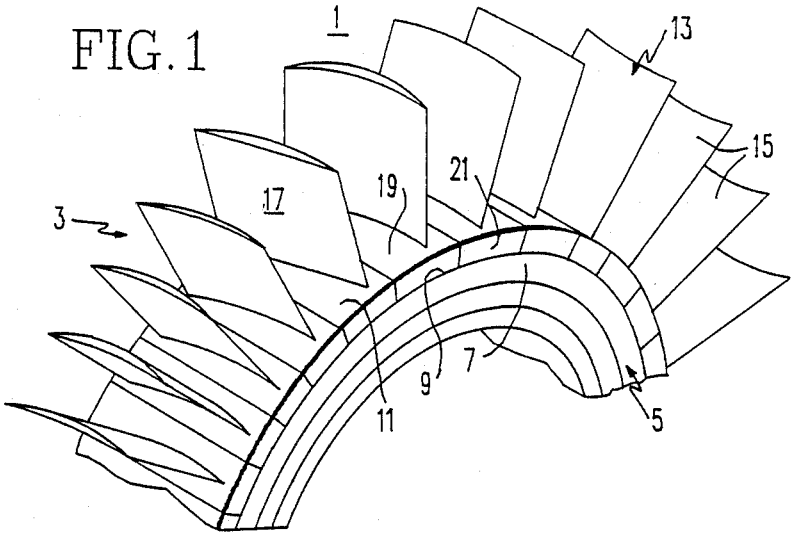
FIG. 1 is a perspective view of a blade support and blade assembly, for a compressor, formed in accordance with the present invention.
Figure 2:
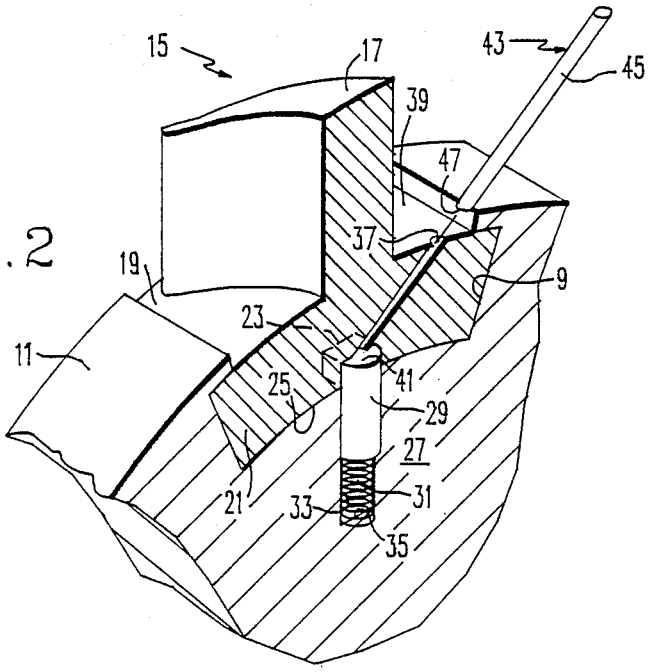
FIG. 2 is a sectional view with a portion cutaway showing the compressor blade and blade assembly with a locking pin in position locking a blade to the blade disk.

Referring now to the drawings, there is illustrated a blade support and blade assembly 1 of the present invention. In the embodiment illustrated in FIG. 1, a compressor blade and disk assembly 3 is illustrated wherein the cylindrical blade support 5 comprises a blade disk 7, the blade disk 7 having a plurality of axially and radially extending slots 9 in the outer peripheral surface 11. A blade 13, in the embodiment of FIG. 1, a compressor blade 15, has an airfoil section 17, a blade base 19, and a root section 21. As is conventional, the root section 21 is slidably mounted in the slot 9 and the root section 21 has a radially extending groove 23 in the lower surface portion 25 thereof (FIG. 2). A biasing means 27 is provided which preferably comprises a locking pin 29 and radially extending coil spring 31, which are contained in a hollow 33 extending radially inward from the bottom region or radially inner end of the slot 9 in the blade support 7 of FIG. 2, the spring disposed between the locking pin 29 and the wall 35 that forms the bottom or radially inner end of the hollow 33 Each groove 23 is alignable radially with a corresponding hollow 33 so as to have coil spring 31 bias the radially outward end portion of the locking pin into the groove 23 of the root 21 of compressor blade 15 when said groove 23 and its corresponding hollow 33 are radially aligned.

The blade 15 has a bore 37 formed therein which extends continuously from the outer surface 39 of the blade base 19 completely through the blade root 21 to the location of the locking pin 29, such that the upper or radially outer end 41 of the locking pin when the latter is biased radially outwardly is adjacent the bore 37. A pin displacement means 43, such as a solid rod 45, having a bottom or inner edge 47, is operative from the outer surface 39 of the blade base 19 through the continuous bore 37 to oppose the biasing force of the biasing means 27 and displace the locking pin 29 from the groove 23 in the blade root 21.

While FIG. 2 illustrates the locking pin 29 in locking engagement in the groove 23 in blade root 21, FIG. 3 shows the use of the pin displacement means 43 to unlock the pin. As shown in FIG. 3, a pin displacement means 43, such as a rod 45, is inserted through the bore 37 and contacts the top or radially outer end of the radially outwardly biased pin 29. By further movement of the rod 45 in the direction of the arrow shown in FIG. 3, the biasing force of the spring 31 is overcome and the pin displaced radially inwardly from the groove 23 such that the blade root 21 and blade 13 can be removed from the slot 9 in the blade support 7 by a sliding movement in the axial direction of the slot 9.

Referring now to FIGS. 4 to 6, an embodiment of the present invention is illustrated wherein the blade support and blade assembly 1 comprise a turbine blade and rotor assembly 49. The cylindrical blade support 5 comprises a rotor 51, with the rotor 51 having a plurality of axially and radially extending slots 9 in the peripheral surface 11 thereof. A blade 13, in this embodiment a turbine blade 52, has an airfoil section 17, a blade base 19, and a root section 21. The root section 21 is slidably mounted in the slot 9 and the root section 21 has a radially extending groove 23 in the lower surface portion 25 thereof. Biasing means 27, comprising a radially extending locking pin 29 and a radially extending coil spring 31 are contained in a radially extending hollow 33 formed to extend radially inward from the bottom region or radially inner surface of the slot 9 in the blade support 5, the rotor 51, with the spring disposed between the locking pin 29 and the wall 35 that forms the bottom of the hollow 33, so as to bias the locking pin radially outwardly into the groove 23 of the root 21 of turbine blade 49.

In FIG. 5, the locking pin 29 is shown engaged in the groove 23 in the blade root 21 and the blade locked in position in the blade support 5, illustrated as a rotor 51. A continuous bore 37, shown as horizontal bore section 53 and vertical bore section 55 communicating therewith, is formed in the blade extending from the outer surface 39 of the blade base 19 completely through the blade root 21 to the location of the locking pin 29. A pin displacement means 43 is provided, which comprises a source of pressurized fluid 57 and a line 59, leading from the source of pressurized fluid 57, such as compressed air or a fluid such as oil, to the opening 61 of the bore 37 in the surface 39 of the blade base 19. The bore 37, adjacent the outer surface 39 of the blade base 19 preferably is formed as a threaded section 63, while the line 59 has a threaded nipple 65 threadedly engageable therewith. In unlocking of the pin 29, as illustrated in FIG. 6, the source of pressurized fluid 57 is connected to the bore 37 by means of line 59, preferably with nipple 65 threadedly engaged in the threaded section 63, and a supply of pressurized fluid is passed through the bore 37 to contact locking pin 29 and overcome the biasing forces of spring 31, so as to displace the locking pin 29 radially inwardly from the groove 23. After such displacement, the blade root 21 and blade 13 may be removed from the slot 9 in the blade support 7 by a sliding movement.

A further improvement is provided in the blade support and blade assembly 1 of the present invention by the use of hardened inserts, as illustrated in FIGS. 7 to 12, which inserts may be positioned in the bottom or radially inner portion of the blade root 21 of a blade 13 or extending from the bottom wall of the slot 9 in the blade support 7. In FIGS. 7 to 9, a cylindrical plug insert 67 is illustrated which is secured in a recess 69 in the base of the root section 21 of a blade 13, with the exposed surface 71 of the hardened plug flush with the lower or radially inner surface 25 of the root section 21. The cylindrical plug has an aperture 73 therein into which the locking pin 29 will fit, and preferably has bevelled edges 75. An alternative or supplemental insert 77 is illustrated in FIGS. 10 to 12, which insert 77 comprises a hollow cylindrical member having a central axial aperture 79 and a threaded outer surface 81. The wall 83 of the hollow 33 formed in the bottom or radially inner region of the slot 9 in the blade support has threads 85 which are threadedly engaged with the threaded outer surface 81 of the hollow cylindrical insert 77 with the upper edge 87 of the insert flush with the bottom or radially inner wall 89 forming the lower or radially inner region of the slot 9 in the blade support 7.

The hardened inserts are formed from a material such as 440C stainless steel, or other hardened material that is more durable than the remainder of the blade and blade support. When the insert 67 is secured in the recess 69 in the base of the blade root section 21 of the blade 13, the insert may be soldered into place, while the insert 77 need only be threadedly engaged in the hollow 33 formed in the bottom or radially inner region of the slot 9, and peened at the edge surface thereof to secure the same in place.

The present invention allows for release of the locking pin holding the blade root in the slot of the blade support, thus permitting the use of stronger locking pins that could not be removed by the conventional method of hammering the blade out of the slot, and also allows for reuse of the locking pin since it is not sheared, as with conventional systems.

We claim:

1. A blade support and blade assembly which comprises:

a cylindrical blade support having a slot in the outer periphery thereof and a hollow extending radially inwardly from said slot;

a blade having an airfoil section, a base, and a root section disposed in said slot, the root section having a radially extending groove therein;

a locking pin having a radially outer end portion positioned for outward radial movement into the groove of said root section to secure said root section to the blade suport and for inward radial movement from said groove; and a coil spring situate in said hollow of said blade suport radially inward of said locking pin for biasing said radially outer portion of said pin into said groove;

said blade having a continuous bore formed therein extending completely through said blade root from the outer surface thereof to the location of the radially outer end of said locking pin when the latter is biased radially outwardly, such that a pin displacement means is operative from the outer surface of said base through said bore to oppose the biasing force of said coil spring and displace the radially outer portion of said pin radially inwardly from said groove, to permit removal of the blade root and blade from said slot wherein said bore, adjacent the outer surface of said blade base is adapted to be engaged with a pressure line, and a source of pressure is provided, with said pressure line connected to said source of pressure, such that a fluid pressure from said source of pressure is exertable through said bore to contact said pin and displace the same from said groove.

2. A blade support and blade assembly as defined in claim 1 wherein said blade support comprises a circular blade disk securable to a rotor.

3. A blade support and blade assembly as defined in claim 1 wherein said bore, adjacent the outer surface of said blade base has a threaded portion and said pressure line is adapted to be threadedly engaged with said threaded portion.

4. A blade support and blade assembly as defined in claim 2 wherein said blade assembly comprises compressor blades.

5. A blade support and blade assembly as defined in claim 1 wherein a hardened insert is provided in at least one of said blade root and said blade support which insert surrounds said locking pin.

6. A blade support and blade assembly as defined in claim 5 wherein said insert is positioned in said groove of the blade root section with the radially inner edge of the insert being flush with the surface of the slot.

7. The blade support and blade assembly as defined in claim 5 wherein said insert is positioned in said blade support, the radially inner edge of said insert being flush with the surface of the slot.

8. A blade support and blade assembly as defined in claim 1 wherein said blade support comprises a rotor.

9. A rotor and blade assembly as defined in claim 8 wherein said rotor is a turbine rotor.

* * * * *